United States Patent [19]

Beardmore et al.

[11] Patent Number: 4,515,093

[45] Date of Patent: May 7, 1985

[54] METHOD AND APPARATUS FOR THE RECOVERY OF HYDROCARBONS

[76] Inventors: David H. Beardmore; Riley B. Needham, both c/o Phillips Petroleum Company, Bartlesville, Okla. 74004

[21] Appl. No.: 354,564

[22] Filed: Mar. 4, 1982

[51] Int. Cl.[3] ..... F23D 1/00

[52] U.S. Cl. ..... 110/347; 48/203; 48/210; 110/215; 110/216; 110/234; 110/261; 110/264; 110/265; 110/266; 122/22; 431/163; 431/173

[58] Field of Search ..... 110/203, 215, 216, 233, 110/234, 260, 261, 262, 263, 264, 265, 266, 297, 342, 344, 345, 347, 348, 171; 122/5.5 A, 22, 211, 421; 431/163, 168, 173; 48/202, 210, 197 B, 203

[56] References Cited

U.S. PATENT DOCUMENTS

| | | | |
|---|---|---|---|
| 2,616,252 | 11/1952 | Robinson et al. | 110/347 |
| 3,124,086 | 3/1964 | Sage et al. | 110/347 |
| 3,856,455 | 12/1974 | Otway et al. | 431/173 |
| 3,971,847 | 7/1976 | Houseman | 431/163 |
| 4,030,889 | 6/1977 | Gunnell | 431/173 |
| 4,147,116 | 4/1979 | Graybill | 110/263 |
| 4,245,569 | 1/1981 | Fallon | 110/215 |
| 4,374,650 | 2/1983 | Garside | 48/203 |
| 4,378,974 | 4/1983 | Petit et al. | 48/210 |
| 4,387,654 | 6/1983 | Binasik et al. | 110/261 |
| 4,397,295 | 8/1983 | Bakker | 110/261 |
| 4,407,205 | 10/1983 | Beaufrere | 110/347 |

FOREIGN PATENT DOCUMENTS

| | | | |
|---|---|---|---|
| 74930 | 6/1977 | Japan | 431/173 |
| 162524 | 12/1980 | Japan | 431/163 |

*Primary Examiner*—Edward G. Favors
*Assistant Examiner*—Steven E. Warner

[57] ABSTRACT

A method for generating steam by a high pressure, high intensity, or high heat release method of combustion in an elongated combustion zone having upstream and downstream ends and an intermediate location and utilizing a normally-solid fuel which produces non-combustible solid residues in which the fuel is introduced axially and a volume of air, at least equal to the stoichiometric amount, is introduced as an annular, rotating stream to produce a rotating vortex of fuel and air, such introduction and flow through the combustion zone being carried out in a manner to collapse the vortex and create plug flow at the intermediate location, burning the fuel and air to produce flue gas at a heat release rate of at least 7 MM Btu/hr, abruptly terminating combustion by the introduction of water, vaporizing the water to produce a mixture of flue gas and steam, and separating solid residues therefrom.

18 Claims, 1 Drawing Figure

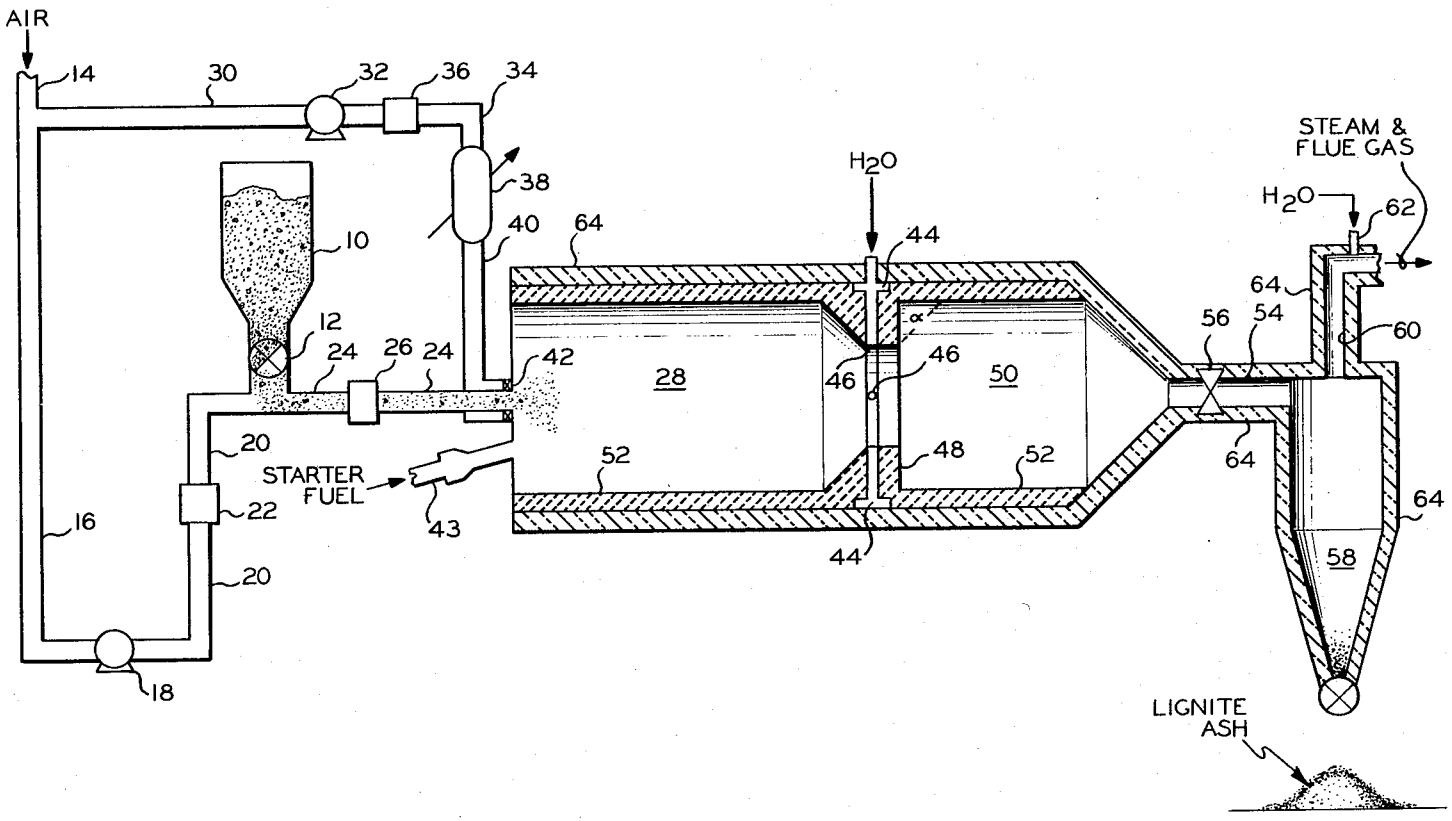
STEAM & FLUE GAS
$H_2O$
LIGNITE ASH
$H_2O$
STARTER FUEL
AIR
10
12
14
16
18
20
22
24
26
28
30
32
34
36
38
40
42
43
44
46
48
50
52
54
56
58
60
62
64

METHOD AND APPARATUS FOR THE RECOVERY OF HYDROCARBONS

The present invention relates to the method and apparatus for the recovery of hydrocarbons. More specifically, the present invention relates to a method and apparatus for the recovery of hydrocarbons by the use of steam.

BACKGROUND OF THE INVENTION

With the rapidly declining availability of hydrocarbon fuels, particularly from petroleum sources, there is a great need to extend efforts for the recovery of the petroleum to sources heretofore practically or economically unattractive and to the recovery of hydrocarbon fuels from alternate sources. A major potential source of petroleum, which has heretofore been virtually untapped because of the inability of most refineries to handle such crudes and the inability and expense of recovering them, are heavy oil deposits. Two basic methods have heretofore been applied in the recovery of such heavy oil deposits, namely; in situ combustion and steam injection methods. Both of these techniques have been limited by the fact that both require the burning of substantial amounts of the oil itself, or equivalent fuels, in order to reduce their viscosity and permit production thereof. This is true even with increased prices of oil. For example, to evaluate the economics of steam injection, the oil/steam ratio (OSR) is utilized. The OSR is the ratio of additional oil recovered for each ton of steam injected. Since it is necssary to burn about eight tons of fuel to get one hundred tons of steam, an OSR of 0.08 has a thermal balance of 0; i.e., you burn as much oil to generate the steam as you produce. Generally, wells in the Kern River Field of California operate with an OSR of 0.24, and are abandoned when they get below 0.15.

However, with the decontrol of heavy oil prices several years ago, substantial work has been done and commercial operations are presently under way utilizing steam recovery techniques for the recovery of heavy oil. In addition, the technology has progressed to the point where application of steam technology to other resource areas such as tar sands, diatomaceous earth, oil shale, and even residual light oil are technically feasible. However, until fairly recently, the state of the art techniques for heavy oil production by steam injection have produced only about 40% to 55% of the oil in place. This of course, is close to the ragged edge of being economic and leaves substantial volumes of oil unrecovered.

Most commercial operations, at the present time, are confined to the use of conventional steam boilers for the generation of steam. Usually, the lease crude is used as a fuel. However, when one considers that 80% to 85% of the cost of a steam injection operation is cost of the fuel, this obviously is a major factor. As a result, a number of alternate energy sources, some rather exotic, have been suggested, including petroleum coke, low BTU lignite coal, natural gas, almond hulls and tree prunings, solar energy, etc. However, except for solar energy, all suggested and used sources of energy for steam generation have the same problems and disadvantages.

First of all, conventional steam boilers waste about 19% of the fuel value in stack losses. Considerable work has been done and progress has been made in the elimination of well bore losses by the use of insulated tubing for the injection of steam.

In addition, numerous heavy oil reservoirs will not respond to conventional steam injection since many have little or no natural drive pressure of their own and even when reservoir pressure is initially sufficient for production, the pressure obviously declines as production progresses. Consequently, conventional steaming techniques are of little value in these cases, since the steam produced is at a low pressure, for example, several atmospheres. Consequently, continuous injection of steam or a "steam drive" is generally out of the question. As a result, a cyclic technique, commonly known as "huff and puff" has been adopted in many steam injection operations. In this technique, steam is injected for a predetermined period of time, steam injection is discontinued and the well shut in for a predetermined period of time, referred to as a "soak". Thereafter, the well is pumped to a predetermined depletion point and the cycle repeated. This technique has the disadvantages that it depends for the recovery of oil, solely on a decrease in viscosity of the oil and the steam penetrates only a very small portion of the formation surrounding the well bore, particularly since the steam is at a relatively low pressure.

However, the most formidable problem with conventional steam generation techniques is the production of air pollutants, namely, $SO_2$, $NO_x$ and particulate emissions. By way of example, it has been estimated that when burning crude oil having a sulfur content of about 2%, without flue gas desulfurization and utilizing 0.3 barrels of oil as fuel per barrel of oil produced, air emissions in a San Joaquin Valley, Calif. operation would amount to about 40 pounds of hydrocarbons, 4,000 pounds of $SO_2$, 800 pounds of $NO_x$ and 180 pounds of particulates per 1,000 barrels of oil produced. When these figures are multiplied in a large operation and a number of such operations exist in a single field, the problems can readily be appreciated. Consequently, under the Clean Air Act, the Environmental Protection Agency has set maximum emissions for such steaming operations, which are generally applied area wide, and states, such as California where large heavy oil fields exist and steaming operations are conducted on a commercial scale, have even more stringent limitations. Consequently, the number of steaming operations in a given field have been severely limited and in some cases it has been necessary to completely shut down an operation. The alternative is to equip the generators with expensive stack gas scrubbers for the removal of $SO_2$ and particulates and to adopt sophisticated $NO_x$ control techniques. This, of course, is a sufficiently large cost to make many operations uneconomic. Further, such scrubbers also result in the production of toxic chemicals which must be disposed of in toxic chemical dumps or in disposal wells where there is no chance that they will pollute ground waters.

It has also been proposed to utilize high pressure combustion systems at the surface of the earth. Such a system differs from the low pressure technique to the extent that the water is vaporized by the flue gases from the combustor and both the flue gas and the steam are injected down the well bore. This has been found to essentially eliminate, or at least reduce or delay, the necessity of stack gas clean up and use of $NO_x$ reduction techniques. The mixture conventionally has a composition of about 60% to 70% steam, 25% to 35% nitrogen, about 4% to 5% carbon dioxide, about 1% to 3% oxygen, depending upon the excess of oxygen employed for complete combustion, and traces of $SO_2$ and $NO_x$. The $SO_2$ and $NO_x$, of course, create acidic materials. However, potential corrosion effects of these materials can be substantially reduced or even eliminated by proper treatment of the water used to produce the steam. There is a recognized bonus to such an operation, where a combination of steam, nitrogen and carbon dioxide are utilized, as opposed to steam alone. In addition to heating the reservoir and oil in place by condensation of the steam, the carbon dioxide dissolves in the oil, particularly in areas of the reservoir ahead of the steam where the oil is cold and the nitrogen pressurizes or repressurizes the reservoir. In fact, in certain types of reservoirs it is believed that the nitrogen creates artifical gas caps which aid in production. As a result of field tests, it has been shown that the high pressure technique results in at least a 100% increase in oil production over the use of steam alone and shortening the time of recovery to about two-thirds of that for steam injection alone. Such tests have generally been confined to injection of steam utilizing the "huff and puff" techinque, primarily because results are forthcoming in a shorter period of time and comparisons can be readily made. However, utilization of the high pressure technique in steam drive operations should result in even further improvements. A very serious problem, however, with the currently proposed above ground high pressure system is that it involves a large hot gas generator operating at high pressures and high temperatures. This creates serious safety hazards and, when operated by unskilled oil field personnel, can have the potential of a bomb. In order to be effective, for steam injection, the power output of the combustor should be at least about 7 MM Btu/hr. In order to be useful in a sufficiently large number of reservoirs, the output pressure must be above about 300 psi. The combustor must also be precisely controlled so as to maintain flame stability and prevent flame out, turbulent flow, etc. Such control must also be exercised in feeding and maintaining proper flow of fuel and combustion supporting gas and combustion stoichiometry for efficient and complete combustion, thereby eliminating incomplete combustion with the attendant production of soot and other particulate materials, since excessive amounts of combustion supporting gas for stoichiometric combustion could contribute to corrosion and excessive amounts of fuel result in incomplete combustion and the production of soot and other particulates. A further problem is the construction of the combustor and its operation to prevent rapid deterioration of the combustion chamber and the deposition of carbonaceous materials in the walls of the combustion chamber. Thus, proper cooling of the combustion chamber is necessary, as well as protection of the walls of the combustion chamber. Efficient evaporation and control of the water are also necessary to produce dry, clean steam. Unless the combustor is properly controlled, in addition to introducing the water into the flue gas properly, the water will prematurely dilute the combustion mixture, resulting in incomplete combustion and creation of the water-gas reaction, as opposed to combustion, and prematurely cool the combustion mixture, again producing excessive soot and particulates. The production of solids is particularly serious when utilizing fuels which produce solid residues, such as ash producing coal, lignite, etc. Consequently, to prevent pluggin of the formation, the use of fuels which produce solid residues has been confined to indirect techniques of steam generation, where steam is produced in a conventional boiler and the flue gas is not used.

It is therefore and object of the present invention, to overcome the above-metnioned and other disadvantages of the prior art. Another object of the present invention is to provide an improved method and apparatus for the generation of steam for hydrocarbon recovery which reduces heat losses. Another and further object of the present invention is to provide an improved method and apparatus for generating steam for hydrocarbon recovery capable of pressurizing and/or repressurizing petroleum reservoirs. A still further object of the present invention is to provide an improved method and apparatus for generating steam for hydrocarbon recovery which greatly reduces or delays environmental pollution. Yet another object of the present invention is to provide an approved method and apparatus for generating steam for hydrocarbon recovery which is safe to use at the surface of the earth. Another object of the present invention is to provide an improved method and apparatus for generating steam for hydrocarbon recovery including a combustor having a high power output. A further object of the present invention is to provide an improved method and apparatus for the production of steam for hydrocarbon recovery capable of operating at a high pressure. Another and further object of the present invention is to provide an improved method and apparatus for the production of steam for hydrocarbon recovery, including a combustor having a high combustion stability and combustion efficiency. A still further object of the present invention is to provide an improved method and apparatus for the generation of steam which utilizes fuels which produce solid residues. Another and further object of the present invention is to provide an improved method and apparatus for generating steam, utilizing a fuel which produces solid residues, in which the solid residues are effectively removed and clean flue gas is advantageously mixed with the steam. Another and further object of the present invention is to provide an improved method and apparatus for the generation of steam for hydrocarbon recovery capable of producing clean, dry steam. A further object of the present invention is to provide an improved method and apparatus for the generation of steam for hydrocarbon recovery capable of efficient and complete production of steam. Yet another object of the present invention is to provide an improved method and apparatus for the generation of steam for hydrocarbon recovery wherein water for the production of steam is introduced in a manner which prevents the interference of the water with combustion and effectively mixes the water with combustion products. These and other objects of the present invention will be apparent from the following description.

SUMMARY OF THE INVENTION

The present invention relates to a method of generating steam, particularly for the recovery of hydrocarbons, utilizing fuels which produce solid residues, such as ash producing coals, lignites, etc., in which the fuel is burned in an elongated combustion chamber and in the presence of a combustion supporting gas in an amount at least equal to the stoichiometric amount necessary for combustion of essentially all of the combustible portion of the fuel to produce a flue gas containing solid residues of the fuel, introducing water into the flue gas adjacent the outlet end of the combustion chamber, maintaining the resultant mixture of flue gas and water in a vaporization chamber having its inlet end directly coupled to the outlet end of the combustion chamber for a time sufficient to vaporize a major portion of the water and produce a mixture of flue gas and steam, and separating the solid residues from the mixture of flue gas and steam to produce a mixture of flue gas and steam essentially free of solid residues.

BRIEF DESCRIPTION OF THE DRAWING

The single FIGURE of the drawings is a simplified flow-type diagram of a system for producing steam in accordance with the present invention.

DESCRIPTION OF THE PREFERRED EMBODIMENTS

The nature of the features and the operation of the method and apparatus of the present invention will be better understood by the following description when read in conjunction with the drawing.

In accordance with the drawing, pulverized coal is supplied by means of a pressurized bin 10, having mounted in its bottom an appropriate feeder means, such as a rotary air lock feeder 12. Transport air for the coal feed is supplied from an appropriate air source, (not shown) through line 14, thence through line 16 to a first air compressor 18. The compressed air then passes through line 20, having mounted therein flow meter 22. The air is then combined with the coal and passed through line 24, having mounted therein pulse elminator 26. The pressurized mixture of air and coal is then fed into the upstream or inlet end of an elongated combustion chamber 28 of the steam generator. Additional air from line 14 is fed to the combustor through line 30 to compressor 32. The compressed air then passes from compressor 32 through line 34, which has mounted therein flow meter 36. The compressed air from line 34 passes to an air heater 38, where the air is heated to an appropriate temperature and then is passed through line 40 to combustion chamber 28. Preferably, the compressed and heated air is introduced into the inlet end of combustion chamber 28 through appropriate swirling or rotating mechanism 42, thus forming a swirling or rotating annular stream of air about the fuel. A torroidal vortex of fuel and air is formed in combustion chamber 28, which not only produces intimate mixing of the fuel and air but also stabilizes the flame in combustion chamber 28 due to the fact that fuel, partially combusted fuel and air feed back into the central vacuum of the vortex. The total air supplied to combustion chamber 28 is supplied in an amount sufficient to provide stoichiometric combustion of the fuel in an amount at least equal to the stoichiometric amount necessary for combustion of essentially all of the combustible portion of the fuel, for example, anywhere from 3 to 15 percent excess over the stoichiometric amount. The mixture of fuel and air is ignited or heated to the ignition temperature by a propane torch lighter 43. The fuel and air are maintained in combustion chamber 28 for a residence time sufficient to essentially complete combustion and produce an effluent comprising flue gas containing solid residues from the fuel, in the case of coal, ash. In order to generate steam, water is supplied to a plenum chamber 44, which then feeds the water into the flue gas adjacent to the downstream end of the combustion chamber. Preferably, the water is introduced into the flue gas in a radial direction toward the center axis of the combustion chamber in a manner such that the water will penetrate to essentially the central axis, thus rapidly quenching the hot flue gases and mixing them with the water. Preferably, the water is supplied to the combustion chamber from the annular plenum 44 through a plurality of apertures 46, which thus introduce the water as a plurality of radial jets spaced about the periphery of the combustion chamber. Mixing of the flue gas and water can be greatly enhanced by reducing the diameter of the exiting flue gases by an orifice or nozzle 48 and introducing the water immediately before, within, or immediately after the reduced portion of the flue gas. In the preferred arrangement, the water is introduced into the reduced diameter portion of the flue gas. After passing through the orifice or nozzle 48, the flue gas or the mixture of flue gas and water is abruptly expanded into vaporization chamber 50. This abrupt expansion also aids in mixing the water and flue gas by reverse circulation. A similar effect can be obtained by simply eliminating the orifice or nozzle 48 and abruptly expanding the flue gas or flue gas-water mixture into a vaporization chamber which is larger than the combustion chamber. In either case, the abrupt expansion should be such that the angle alpha with respect to the wall of the combustion chamber is greater than about 15°, in the present case, 90°, in order to prevent streamline flow along the walls of the combustion chamber. This arrangement of reduction and expansion or expansion, together with the introduction of the water immediately adjacent such reduction and expansion or expansion has the further advantage that is prevents back flow of water into the combustion chamber 28 and thus premature quenching or cooling of the flue gases. The previously mentioned torroidal vortex of fuel and air in combustion chamber 28 is necessary to the operation of the system of the present application to the extent that flame speed is to be maintained substantially above laminar flame speed. If the velocity substantially laminar flame speed is employed without creation of a torroidal vortex or the like, the flame will have a tendency to go out and will be unstable. The subject torroidal vortex collapses toward the downstream end of combustion chamber 28 and flow changes to a uniform flow across the cross section of the combustion chamber or plug type flow. The interior of combustion chamber 28 and vaporization chamber 50 are lined with a ceramic or refractory lining 52 in order to prevent deposits from forming on the walls and destruction of the walls by the hot gases, particularly in the combustion chamber. Accordingly, since combustion has been essentially complete and the temperature has been substantially reduced by the time the mixture enters the vaporization chamber 50, it may not be necessary to provide a refractory lining in combustion chamber 28 in some cases. The direct coupling of the inlet end or upstream end of vaporization chamber 50 to the outlet end or the downstream end of combustion chamber 28, has a number of very distinct advantages in accordance with the present invention. If the two units were separate and the solid residues or ash in the flue gas were spearated between, separation equipment would be subject to and require provision for the handling of flue gases that are high pressure and a high temperature, for example, in the range of about 1300° to 1500° F. This, of course, is a severe limitation. In addition, if the coal or fuel is fed to the combustion chamber 28 as a slurry of coal and water, for example, the separation equipment would also be subjected to severe corrosion problems since most fuels which produce solid residues or ash also contain significant amounts of sulfur, which results in the production of sulfur oxides and the burning of the fuel with air results in the production of significant amounts of nitrogen oxides, both of which produce strong acids in the presence of water.

The mixture of flue gas and water is maintained in vaporization chamber 50 for a residence time sufficient to vaporize a major portion of the water, depending upon the quality of steam desired. The mixture of steam and flue gas is discharged from the outlet or downstream end of vaporization chamber 50 through line 54. Line 54 is also provided with an appropriate pressure control valve 56 adapted to maintain the pressure within the combustor at design operating pressure and thus control the outlet pressure of the mixture of steam and flue gas. Such a valve can be automatic and can also be mounted in the downstream or outlet end of vaporization chamber 50. The mixture of steam and flue gas passing through line 54 and containing solid residue or ash from the fuel is then passed to an appropriate separator means 58, such as one or my cyclonetype separators. In separator 58, the solid residues or ash, which would tend to plug the producing formation into which the stimulating fluid is to be injected, is separated and discarded while the clean mixture of steam and flue gas is discharged through line 60. The steam and flue gas mixture for hydrocarbon recovery is preferably passed to the well head through line 60, for injection into a subsurface formation. If desired, additional water may be supplied to the mixture of steam and flue gas through line 62 in order to adjust the steam quality to the desired level. In most instances, however, the steam should be superheated steam, since a certain amount of heat loss will occur in injecting the recovery fluid down the well bore. The combustion chamber, the vaporization chamber, the flow lines to the separator, the separator and the flow lines to the point of utilization and, if utilized in a subsurface formation, the flow line in the well should be provided with an appropriate insulation 64.

In the operation of the system of the present invention, the pulverized fuel, such as coal, lignite, etc., is generally ground to a size such that about 70 to 80 percent thereof will pass through a 200 mesh screen (U.S. Standard Sieve) thus having a maximum size of about 74 microns. As shown in the drawing, the solid fuel may be introduced into the combustor suspended in a pressurized transport gas, such as air. However, it is also contemplated that the solid fuels may be introduced in admixture with water, for example, as a water-fuel solution for "disruptive vaporization" of fuel droplets, as a water-fuel emulsion, for "explosive atomization", etc. In these cases, the introduction of a solid fuel is simplified to the extent that the problems of handling and introduction of solid particles suspended in pressurized transport gas are eliminated and the water-fuel mixture can simply be pumped to the combustor, also, a water-fuel mixture can be introduced into the combustion chamber in essentially the same manner as liquid fuels are introduced into a combustor, namely, as a spray, preferably at a diverging angle having an apex angle of, for example, 90°. Whether the fuel is suspended in transport gas or introduced as a fuel-water mixture, such fuels have a tendency to become tacky and therefore, form deposits on hot surfaces, particularly in the end of the fuel introduction means adjacent the upstream end of the combustor. These deposits, of course, form on the inside walls of the introduction means causing eventual plugging. Therefore, it is desirable to cool this portion of the introduction means to prevent the build up of deposits on the inner surface of the introduction means. Such cooling is conveniently carried out by passing a stream of cooling fluid, for example, water, through an annular space formed about this portion of the fuel introduction means.

As previously indicated, combustion supporting gas, particularly air, or additional air, if air is used as a transport medium, is introduced into the combustion chamber as a swirling or rotating annular stream about the stream of fuel to thereby form a torroidal vortex rotating in a clockwise or counterclockwise direction and moving from the upstream end toward the downstream end of the combustion chamber. This torroidal vortex is necessary to maintain flame stability and prevent flame-out, etc. in a high pressure combustor, which is the preferred embodiment in the present case. This torroidal vortex eventually collapses before reaching the downstream end of the combustion chamber and changes to a uniform flow across the combustor or a "plug-type" flow. In the case illustrated in the drawings, the diameter of the combustor is generally greater than about 6 inches. However, the diameter should be maintained small, for example, about 13 inches in diameter in order to increase the safety of the device. By maintaining the diameter small, the generator can be operated at high pressure and be as safe as conventional process heaters and the like as opposed to potentially dangerous, the extremely large high pressure combustor suggested and tested by the prior art workers. In the particular instance shown, the interior of the combustor is lined with a refractory material to prevent build up of deposits on walls of the combustor and damage to the walls of the combustor, as would be the case if the combustor were a steel pipe or the like. In addition, a conventional insulation may be wrapped about the outer surface of the combustor. However, it is also within the scope of the present invention to cool the walls of the combustor by indirect heat exchange, for example, with a portion of the water later introduced into the flue gas being passed through an annular space about the outer surface of a steel pipe or the like. In this case, it is also desirable to utilize a portion of the combustion supporting gas to prevent the formation of deposits and damage to the interior of a steel combustion chamber. This can be accomplished by introducing a second portion of air as a swirling or annular stream between the first torroidal vortex and the wall of the combustion chamber and rotating in the opposite direction of the torroidal vortex. The total volume of air introduced into the combustion chamber for supporting combustion is at least equal to the stoichiometric amount necessary for stoichiometric combustion of the combustible portion of all of the fuel. Typically, the air would be introduced in an amount sufficient to provide an excess over stoichiometric volumes of about 3 to 15 percent excess oxygen, preferably, the latter. The air introduced into the combustion chamber is preferably preheated to a temperature between ambient temperature and adiabetic temperature, preferably between ambient temperature and about 800° F. and, in the case illustrated, to a temperature of about 600° F. In order to provide sufficient residence time in the combustion chamber for essentially complete combustion of the combustable materials in the fuel, a combustor having a combustion chamber of about 3 to 4 inches in diameter would be about 9 ft. long. Obviously, if the diameter is larger, the combustor may be shorter and provide essentially the same residence time. It is also possible to further shorten the length of a given diameter combustor by mounting at least one orifice or nozzle to reduce the cross sectional diameter of the flowing fluids by about 30 percent, anywhere between about the midpoint of the combustor down to the downstream end thereof. Such orifices or nozzles will aid in the mixing of the fuel and air and usually reduce the necessary residence time for complete combustion. The flow velocity in the combustor is maintained above laminar flow flame speed. Consequently, the reference velocity (cold flow) maintained in the combustion chamber should be between about 1 and 200 feet per second, preferably between 10 and 200 feet per second and still more preferably, between about 50 and 100 feet per second, depending upon the desired heat output of the combustor. The flow velocity, at flame temperature, should be between about 5 and 1,000 feet per second, preferably between 50 and 1000 feet per second and still more preferably between about 100 and 500 feet per second. In order to generate steam for injection into an oil reservoir, the power output of the combustor should be at least about 7 MM Btu/hr. for effective and economical stimulation of a well in most heavy oil fields. Consequently, the heat release of the combustion process should be at least about 50 MM Btu/hr. ft.$^3$. Such a heat release rate is about 3 orders of magnitude greater than the heat release of typical oil fired boilers currently in use in heavy oil recovery. In the case illustrated by the drawing, the heat output of the combustor is selected to be about 100 MM But/hr.

Water is introduced into the flue gas in a generally radial direction toward the central axis of the body of flue gas to thereby obtain rapid quenching and mixing of the water with the flue gas. Preferably, such radial introduction would be through a plurality of openings spaced about the periphery of the combustion chamber to thus produce a plurality of radial jets. To aid in this mixing, the flue gas or flue gas and water mixture may be abruptly expanded into the vaporization chamber at an angle with respect to the wall of the vaporization chamber in excess of about 15°. If this angle is less than about 15°, streamlined flow along the walls of the vaporization chamber will occur and inadequate mixing will also occur, as well as some feed back of the water into the combustion chamber, which in turn, prematurely cools or quenches the flue gas and results in the production of excessive carbon and the like and unburned fuel. The abrupt expansion also prevents such backflow of the water into the combustion chamber by causing reverse circulation adjacent the expansion means. Mixing and reduction of backflow of water can be further aided by reducing the diameter of the flue gas or the flue gas and water and, thereafter, abruptly expanding. The water may be injected immediately prior to the reduced section of flue gas, into the reduced section of flue gas or immediately after such reduction. The vaporization chamber has a length sufficient to provide a residence time to vaporize a major portion of the water, preferably, to a temperature to produce superheated steam. Other flue gas-steam outlet temperatures and thus steam qualities can be obtained by simply adjusting the water flow rate. If, for example, in a 5-inch diameter vaporization chamber, the outlet temperature is to be maintained about 500° F. (78° F. superheat) the necessary residence time could be provided by a vaporization chamber having a length of about 26 inches. The outlet pressure of the flue gas-steam should be in excess of about 200 psi, preferably above about 300 psi for the fluids to penetrate the formation in most heavy oil fills. However, this presure would, of course, vary where the flue gas-steam mixture is to be utilized for the recovery of other than heavy oils. For example, if the mixture is to be used in the recovery of shale oil, superheat of about 600° F. (an outlet temperature of about 1,000° F.) is believed necessary.

To attain efficient operation, the design and operation of the unit should be at the design combustion chamber flow velocity and the design vaporization chamber flow velocity, which in turn produce the design output pressure of the unit. Operation at a higher combustion flow velocity results in incomplete combustion, accompanied by excessive deposits in the burner, excessive carbon particles in the output fluids and possible formation plugging and possible flame out. Operation at a lower combustion chamber flow velocity results in a reduced heat output below the design heat output of the burner. Similarly, if the vaporization chamber is operated at design flow velocity, sufficient residence time is provided for essentially complete vaporization of the water. Operation of the vaporization chamber at a higher flow velocity reduces water evaporation efficiency and uniformity of temperature distribution at the outlet and operation of the steam generator at a lower velocity reduces steam generation below the design steam output. The design flow velocities in the combustion chamber and the vaporization chamber (and in turn the design output pressure) are, in turn, determined by the fuel and air flow rates and water flow rate, respectively. Operation at or near design output pressure, as discussed above, assumes that there are no outside forces acting on the generator. This is not the case in downhole operations. In downhole operations, the formation fluid pressure creates a back pressure in the generator, thus reducing the output pressure and the formation fluid pressure changes during operation, for example, the formation fluid pressure initially increases as the volume of fluids forced into the formation increase and later decreases as formation fluid is produced. Consequently, the design output pressure is impossible to maintain throughout a given injection operation. If the outlet pressure is below the design pressure, the heat release of the combustor is reduced, thus derating the combustor. Therefore, the pressure in the combustion chamber and vaporization chamber are preferably maintained by a pressure control valve at the outlet end of the vaporization chamber. In the system illustrated in the drawings, a pressure of about 300 psi is maintained in the combustion chamber and vaporization chamber. This control can be made automatic by sensing the pressure in the vaporization chamber adjacent the outlet end thereof and adjusting the pressure control valve in accordance with sensed changes in the pressure. After passing through a separator for the removal of ash from the flue gas-steam mixture, the mixture is fed to the well head for utilization in hydrocarbon recovery. After passing through the separator, the flue gas-steam mixture will have a pressure of about 250 psi in the exemplified system.

While specific materials, modes of operation and items of equipment have been described herein, it is to be understood that these specific recitals are by way of illustration only and are not to be considered limiting.

What is claimed is:

1. A method for generating steam by a high pressure, high intensity, or high heat release method of combustion in an elongated combustion zone having upstream and downstream ends on an intermediate location and utilizing a normally-solid, fuel which produces non-combustible solid residues, comprising:

(a) introducing said fuel axially into said upstream end of said elongated combustion zone;

(b) introducing a first volume of combustion-supporting gas into said upstream end of said combustion zone, as an annular, rotating stream about said fuel, in a manner to produce a rotating, toroidal vortex, of said fuel and said first volume of combustion-supporting gas, moving from said upstream end toward said downstream end of said combustion zone;

(c) said first volume of combustion-supporting gas being in an amount at least equal to the stoichiometric amount necessary for combustion of essentially all of the combustible portion of said fuel;

(d) said fuel and said first volume of combustion-supporting gas being introduced into and flowed through said combustion zone in a manner to collapse said vortex, at said intermediate location in said combustion zone, to produce an intimate mixture of said fuel and said first volume of combustion-supporting gas and produce plug-type flow through the remaining downstream portion of said combustion zone;

(e) burning said fuel in the presence of said first volume of combustion-supporting gas while thus flowing the same through said combustion zone under conditions to produce a heat release rate of at least about 7 MM Btu/hr and a flue gas containing non-combustible solid residues of said fuel;

(f) abruptly terminating said burning of said fuel, adjacent said downstream end of said combustion zone, at least in part, by introducing water into said flue gas to form a mixture of said flue gas and said water;

(g) maintaining said mixture of flue gas and water in an vaporization zone, directly coupled to and in open communication with said downstream end of said combustion zone, for a time sufficient to vaporize a major portion of said water and produce a mixture of said flue gas and steam; and (h) separating said solid residues from said mixture of flue gas and steam.

2. A method in accordance with claim 1 wherein the fuel is introduced into the combustion zone as a suspension of solid particles in a second volume of combustion-supporting gas.

3. A method in accordance with claim 1 wherein the fuel is introduced into the combustion zone as a water-fuel emulsion.

4. A method in accordance with claim 1 wherein the fuel is introduced into the combustion zone as a water-fuel solution.

5. A method in accordance with claim 1 wherein the fuel is lignite.

6. A method in accordance with claim 1 wherein the fuel is coal.

7. A method in accordance with claim 1 wherein the fuel is in the form of solid particles of which about 70%–80% pass a 200 mesh screen, as measured by U.S. Standard Sieve.

8. A method in accordance with claim 1 wherein the combustion-supporting gas is air.

9. A method in accordance with claim 1 wherein the volume of air is sufficient to provide about 15% excess oxygen above the stoichiometric amount.

10. A method in accordance with claim 1 wherein the vortex is collpased, an intimate mixture of the fuel and the first volume of combustion-supporting gas is produced and plug-type flow is produced by maintaining said vortex in the combustion zone for a time sufficient to cause the natural collapse of said vortex.

11. A method in accordance with claim 1 wherein the vortex is collpased, an intimate mixture of the fuel and the first volume of combustion-supporting gas is produced and plug-type flow is produced by reducing the peripheral dimension of said vortex and, thereafter, expanding the mixture of fuel and the first volume of combustion-supporting gas.

12. A method in accordance with claim 1 wherein the burning is abruptly terminated, at least in part, by introducing the water into the flue gas, in a generally radially direction, adjacent the downstream end of the combustion zone.

13. A method in accordance with claim 12 wherein the water is introduced in a generally radial direction from a plurality of points spaced about the periphery of the combustion zone.

14. A method in accordance with claim 1 wherein the burning is abruptly terminated, at least in part, by abruptly expanding the flue gas and the water adjacent the point of introduction of said water.

15. A method in accordance with claim 14 wherein the peripheral dimension of one of the flue gas and the mixture of flue gas and water is reduced immediately prior to the abrupt expansion.

16. A method in accordance with claim 15 wherein the water is introduced into the flue gas immediately before, within or immediately after the reduction in peripheral dimension.

17. A method in accordance with claim 16 wherein the water is introduced into the flue gas within the portion thus reduced in peripheral dimension.

18. A method in accordance with claim 1 wherein the mixture of flue gas and steam, thus separated from the solid residues fuel, is injected into an oil-bearing subsurface formation to assist in the recovery of oil from said formation.

* * * * *

UNITED STATES PATENT AND TRADEMARK OFFICE

CERTIFICATE OF CORRECTION

PATENT NO. : 4,515,093

DATED : May 7, 1985

INVENTOR(S) : David H. Beardmore and Riley B. Needham

It is certified that error appears in the above-identified patent and that said Letters Patent are hereby corrected as shown below:

Please add to the first page of the patent the following:

--- Assignee: Phillips Petroleum Company
Bartlesville, Okla. ---

Signed and Sealed this

Ninth Day of February, 1988

*Attest:*

DONALD J. QUIGG

*Attesting Officer*

*Commissioner of Patents and Trademarks*